US007574781B2

(12) United States Patent
Ackerman et al.

(10) Patent No.: US 7,574,781 B2
(45) Date of Patent: Aug. 18, 2009

(54) CLOSURE ASSEMBLY WITH SLIDER

(75) Inventors: Bryan L. Ackerman, Freeland, MI (US); Leland J. Smith, Midland, MI (US); James C. Pawloski, Bay City, MI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 453 days.

(21) Appl. No.: 11/453,610

(22) Filed: Jun. 15, 2006

(65) Prior Publication Data

US 2006/0282996 A1 Dec. 21, 2006

Related U.S. Application Data

(63) Continuation-in-part of application No. 10/821,341, filed on Apr. 9, 2004, now Pat. No. 7,410,298.

(51) Int. Cl.
*A44B 19/16* (2006.01)

(52) U.S. Cl. ..... 24/399; 24/30.5 R; 24/400; 383/64

(58) Field of Classification Search ..... 24/399, 24/400, 415, 30.5 R; 383/64
See application file for complete search history.

(56) References Cited

U.S. PATENT DOCUMENTS

| | | | |
|---|---|---|---|
| 1,666,110 | A | 4/1928 | Statham |
| 2,867,877 | A | 1/1959 | Staller et al. |
| 2,875,491 | A | 3/1959 | Morin |
| 2,929,123 | A | 3/1960 | Schneideman |
| 3,074,137 | A | 1/1963 | Hawley |
| 3,103,049 | A | 9/1963 | Hawley |
| 3,115,689 | A | 12/1963 | Jacobs |
| 3,122,807 | A | 3/1964 | Ausnit |
| 3,172,443 | A | 3/1965 | Ausnit |
| 3,173,184 | A | 3/1965 | Ausnit |
| 3,220,076 | A | 11/1965 | Ausnit et al. |
| 3,324,520 | A | 6/1967 | Ausnit |
| 3,426,396 | A | 2/1969 | Laguerre |
| 3,660,875 | A | 5/1972 | Gutman |
| 3,713,923 | A | 1/1973 | Laguerre |
| 3,806,998 | A | 4/1974 | Laguerre |
| 3,959,856 | A | 6/1976 | Ausnit |
| 4,186,786 | A | 2/1980 | Kirkpatrick |
| 4,285,105 | A | 8/1981 | Kirkpatrick |

(Continued)

FOREIGN PATENT DOCUMENTS

| | | |
|---|---|---|
| EP | 941 937 | 9/1999 |

(Continued)

*Primary Examiner*—Robert J Sandy

(57) ABSTRACT

A closure assembly useable with a pouch or bag includes an elongate seal assembly and a slider. The seal assembly includes upper and lower interlocking profiles and a rib disposed between the interlocking profiles on at least one side of the seal assembly. The slider includes forward closure bars at a first end and a separator finger and lower closure bars adjacent to an opposing second end. The forward and lower closure bars occlude the upper and lower interlocking profiles. The separator finger extends between the upper interlocking profiles and presses outwardly against the rib to deocclude the lower interlocking profiles. The lower interlocking profiles can be occluded along substantially an entire length thereof. The slider also includes a retention plate and pressing members, which operatively retain the slider on the seal assembly and may increase the opening force created by the separator finger against the rib.

17 Claims, 6 Drawing Sheets

U.S. PATENT DOCUMENTS 4,341,575 A 7/1982 Herz
4,363,345 A 12/1982 Scheibner
4,409,705 A 10/1983 Yuunaga
4,428,788 A 1/1984 Kamp
4,430,070 A 2/1984 Ausnit
4,513,484 A 4/1985 Iblings
4,541,117 A 9/1985 Ashbeck
4,778,282 A 10/1988 Borchardt et al.
4,812,056 A 3/1989 Zieke
4,817,188 A 3/1989 Van Erden
4,829,641 A 5/1989 Williams
4,907,321 A 3/1990 Williams
4,922,586 A 5/1990 Robson
4,929,225 A 5/1990 Ausnit et al.
4,944,072 A 7/1990 Robson
5,007,142 A 4/1991 Herrington
5,007,143 A 4/1991 Herrington
5,009,828 A 4/1991 McCree
5,010,627 A 4/1991 Herrington et al.
5,017,021 A 5/1991 Simonsen et al.
5,020,194 A 6/1991 Herrington et al.
5,063,644 A 11/1991 Herrington et al.
5,067,208 A 11/1991 Herrington, Jr. et al.
5,070,583 A 12/1991 Herrington
5,092,684 A 3/1992 Weeks
5,174,658 A 12/1992 Cook et al.
5,209,574 A 5/1993 Tilman
5,283,932 A 2/1994 Richardson et al.
5,301,394 A 4/1994 Richardson et al.
5,403,094 A 4/1995 Tomic
5,405,478 A 4/1995 Richardson et al.
5,442,837 A 8/1995 Morgan
5,442,838 A 8/1995 Richardson et al.
5,448,808 A 9/1995 Gross
5,509,734 A 4/1996 Ausnit
5,588,187 A 12/1996 Swain
5,664,299 A 9/1997 Porchia et al.
5,689,866 A 11/1997 Kasai et al.
5,729,876 A 3/1998 Johnson
5,809,621 A 9/1998 McCree et al.
5,839,831 A 11/1998 Mazzocchi
5,867,875 A 2/1999 Beck et al.
5,871,281 A 2/1999 Stolmeier et al.
5,896,627 A 4/1999 Cappel et al.
5,947,603 A 9/1999 Tilman
5,953,796 A 9/1999 McMahon et al.
5,956,815 A 9/1999 O'Connor et al.
5,983,466 A 11/1999 Petkovsek
6,014,795 A 1/2000 McMahon et al.
6,036,364 A 3/2000 Heuvel
6,047,450 A 4/2000 Machacek et al.
6,088,887 A * 7/2000 Bois ..... 24/399
6,112,374 A 9/2000 Van Erden
6,178,722 B1 1/2001 McMahon
6,220,754 B1 4/2001 Stiglic et al.
6,257,763 B1 7/2001 Stolmeier et al.
6,270,257 B1 8/2001 Yeager
6,290,391 B1 9/2001 Buchman
6,290,392 B1 9/2001 Sandor
6,293,701 B1 9/2001 Tomic
6,305,844 B1 10/2001 Bois
6,361,209 B1 3/2002 LaRue et al.
6,439,771 B1 8/2002 Herrington, Jr.
6,461,042 B1 * 10/2002 Tomic et al. ..... 383/64
6,477,821 B1 11/2002 Bois
6,481,890 B1 11/2002 VandenHeuvel
6,490,769 B2 12/2002 Siegel
6,595,689 B1 7/2003 Borchardt et al.
6,609,353 B1 8/2003 McMahon et al.
6,609,827 B2 8/2003 Bois et al.
6,611,996 B2 9/2003 Blythe et al.
6,632,021 B2 10/2003 Bois et al.
6,666,580 B2 12/2003 Bois
6,691,383 B2 2/2004 Linton
6,698,926 B2 3/2004 Buchman
6,733,178 B2 5/2004 Bois
6,739,755 B2 5/2004 Schreiter
6,755,569 B2 6/2004 Bois
6,761,481 B1 7/2004 Bois
6,789,947 B1 9/2004 Kasai
6,817,763 B2 11/2004 Tomic
6,854,886 B2 2/2005 Piechocki et al.
6,854,887 B2 2/2005 Anderson
6,874,205 B1 4/2005 Savicki
6,874,935 B2 4/2005 Edelman et al.
6,880,972 B2 4/2005 Plourde
6,883,210 B1 4/2005 Savicki
6,896,409 B2 5/2005 Plourde et al.
6,901,637 B2 6/2005 Machacek
6,902,321 B2 6/2005 Bois
6,915,546 B2 7/2005 Kasai
6,951,421 B2 10/2005 Crunkleton et al.
6,962,440 B2 11/2005 Fenzl et al.
6,996,879 B1 2/2006 Savicki
7,017,241 B2 3/2006 Bentsen
7,036,987 B2 5/2006 Crunkleton et al.
2001/0039698 A1 11/2001 Siegel
2002/0034342 A1 3/2002 Bois
2002/0034344 A1 3/2002 Bois
2003/0202718 A1 10/2003 Tomic
2003/0217444 A1 11/2003 Blythe et al.
2004/0037479 A1 2/2004 Bentsen
2004/0045138 A1 3/2004 Kasai
2004/0086206 A1 5/2004 Tomic
2004/0161167 A1 8/2004 Ausnit et al.
2004/0161168 A1 8/2004 Crunkleton et al.
2004/0161169 A1 8/2004 Fenzl et al.
2004/0161172 A1 8/2004 Crunkleton et al.
2004/0161173 A1 8/2004 Linton et al.
2004/0252916 A1 * 12/2004 Smith et al. ..... 383/64
2005/0008267 A1 1/2005 Linton et al.
2005/0084183 A1 4/2005 Ausnit
2005/0108861 A1 5/2005 Herrington et al.
2006/0029300 A1 2/2006 Yoder

FOREIGN PATENT DOCUMENTS

JP 6-77518 11/1994
JP 7-51346 11/1995
JP 8-214920 8/1996
JP 10-503672 4/1998
JP 2000-023716 1/2000
JP 2000-152810 6/2000
JP 2001-247137 9/2001
JP 2002-128073 5/2002
JP 2004-161305 6/2004
WO WO 92/20252 11/1992
WO WO 99/62781 12/1999

* cited by examiner

CLOSURE ASSEMBLY WITH SLIDER

CROSS REFERENCE TO RELATED APPLICATIONS

This application is a continuation-in-part of U.S. patent application Ser. No. 10/821,341, filed Apr. 9, 2004 now U.S. Pat. No. 7,410,298, by Bryan L. Ackerman and incorporated by reference herein in the entirety thereof.

REFERENCE REGARDING FEDERALLY SPONSORED RESEARCH OR DEVELOPMENT

Not applicable

SEQUENTIAL LISTING

Not applicable

BACKGROUND

1. Field of the Disclosure

The present disclosure relates generally to closure assemblies including a slider often disposed on, for example, pouches, such as resealable thermoplastic bags.

2. Description of the Background

Resealable seal assemblies for thermoplastic plastic bags are used to seal bag mouths. Closure mechanisms having a single pair of opposing elongate interlocking profiles that are occluded between a user's fingers to create a resealable seal are well known. In addition, closure mechanisms having multiple pairs of elongate interlocking profiles, for example, opposing upper and lower interlocking profiles that are pressed together by the user's fingers, are also used to create a stronger and more secure seal than single pairs. It is also known to use sliders with closure assemblies that have single and multiple interlocking profile pairs to open and close the seal.

In one instance, a seal assembly is sealed and unsealed by occluding and de-occluding the interlocking profiles in a pinch and seal manner by the user's fingers. A user seals the bag by pressing together the interlocking profiles with his/her fingers and unseals the bag by pulling the profiles apart with his/her fingers. The seal assembly has a first closure strip disposed on one bag wall and a second strip disposed on an opposing bag wall. Each of the first and second closure strips includes two parallel spaced apart interlocking profiles disposed between two bumper profiles, all of which extend from a same side of a backing flange. In addition, one of the closure strips has a central rib profile disposed between the two interlocking profiles.

In another instance, a bag has a slider attached to a resealable seal assembly that has two pairs of interlocking profiles to easily occlude and de-occlude the seals. The slider has two opposing walls that occludes both pairs of interlocking profiles when slid in a closing direction along the seal assembly. The slider also has a separator finger, or plow, that extends downwardly between both pairs of interlocking profiles that de-occludes both pairs of interlocking profiles when the seal assembly when slid in an opening direction. However, extending the plow all the way through the opposing interlocking profiles can create a gap or opening around the plow even when the slider is all the way in a closed position on the seal assembly, which results in a non-continuous seal that may cause leaking of liquid or granular contents held inside the bag.

In a further instance, a slider for a double zipper assembly has a separator plow that extends from a top wall to a location between an upper closure mechanism and a lower closure mechanism. A distal end of the separator plow does not extend between the lower closure mechanisms. Rather, a horizontal plate extends laterally outwardly from opposite sides of the distal end of the separator plow and presses outwardly on both opposing sidewalls between of the upper and lower closure mechanisms. The horizontal plate is wide enough to force the lower closure mechanism apart by urging the sidewalls apart. A docking area is disposed at a closing end of the double zipper assembly. The docking area has a hole or slit through at least one or both of the sidewalls so that the horizontal plate will extend through the holes without urging the sidewalls apart, thereby not forcing the lower closure mechanism apart at the closing end.

SUMMARY OF THE INVENTION

In one aspect of the invention, a resealable closure assembly has a first sidewall including a first plurality of mating elements extending along the first sidewall. The resealable closure assembly also has a second sidewall opposing the first sidewall including a second plurality of mating elements extending along the second sidewall. The first plurality of mating elements resealably mates with the second plurality of mating elements. A rib extends along the first sidewall and is disposed between two adjacent mating elements of the first plurality of mating elements. The resealable closure assembly also has a slider adapted to mate and unmate the first and second plurality of mating elements. The slider includes a separator finger that unmates a first pair of opposing mating elements by pressing outwardly against the rib. The first pair of opposing mating elements is disposed beyond a distal end of the central protrusion According to another aspect of the invention, a reclosable closure assembly includes a first closure element disposed along a first sidewall and a second closure element disposed along the first sidewall and spaced from the first closure element. A third closure element is disposed along a second sidewall opposite the first sidewall and a fourth closure element is disposed along the second sidewall and spaced from the third closure element. An elongate ridge extends along the first sidewall and is disposed between the first and second closure elements. A slider adapted to occlude and de-occlude the first and second closure elements with the third and fourth closure elements, respectively, includes a central protrusion that extends between the first and third closure elements and de-occludes the second and fourth closure elements by pressing outwardly against the elongate ridge. The central protrusion does not extend between the second and fourth closure elements.

In yet another aspect of the invention, a slider includes first and second opposing faces extending from a top wall and defining a channel therebetween. A first closing members extends into the channel from the first and second opposing faces and is disposed adjacent to a first end of the slider. A separating member extends into the channel from the top wall adjacent to a second end of the slider opposite the first end. The separating member is spaced between the first and second opposing faces. A second closing members extending into the channel from the first and second opposing faces and is spaced from the top wall. The second closing members are disposed between the separating member and the first closing members, and a distal end of the separating member is disposed between the second closing members and the top wall.

Other aspects and advantages of the present disclosure will become apparent upon consideration of the following detailed description in which:

DETAILED DESCRIPTION

Figure 1:
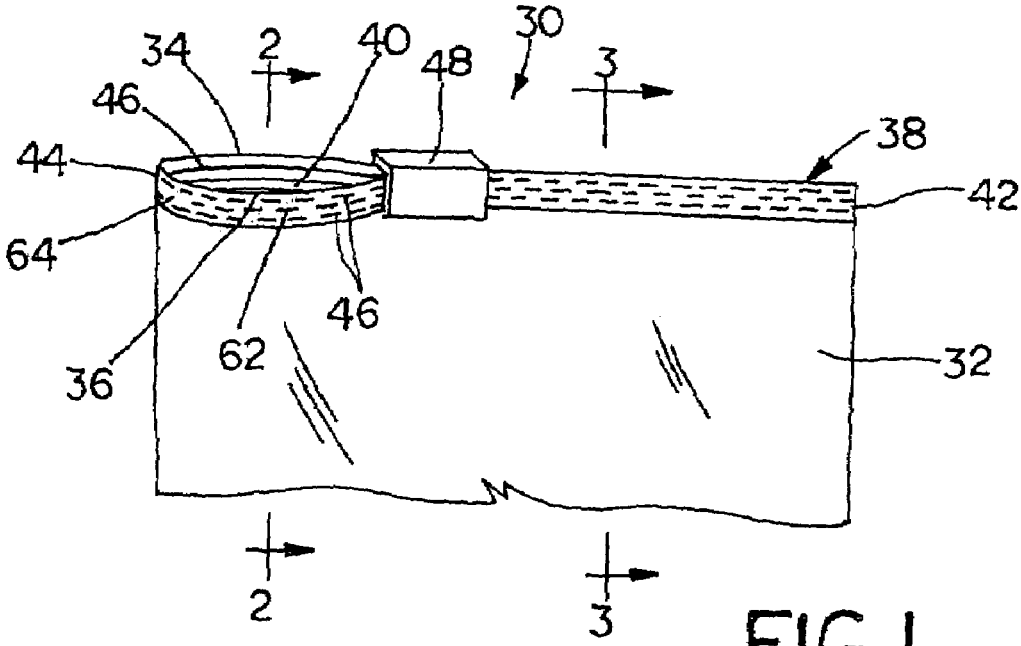
FIG. 1 is an isometric view of a container in the form of a plastic bag according to an embodiment of the invention.

Turning now to the drawings, FIG. 1 shows a closure assembly 30 disposed on a bag 32 that has a pair of opposing sidewalls 34 and 36, and an elongate seal assembly 38 disposed to open and close a mouth 40 of the bag. The seal assembly 38 may be unsealed and resealed and extends between an open end 42 and a closed end 44 and includes elongate sealing elements 46 extending along each sidewall 34, 36. A slider 48 is operatively engaged to the seal assembly 38 so as to open and close the bag mouth 40. When the slider 48 is slid towards the closed end 44, the bag mouth 40 is closed by urging the opposing sidewalls 34, 36 together and occluding opposing pairs of the sealing elements 46. When the slider 48 is slid towards the open end 42, the bag mouth 40 is opened by urging the opposing sidewalls 34, 36 apart and de-occluding the opposing pairs of sealing elements 46.

Figure 2:
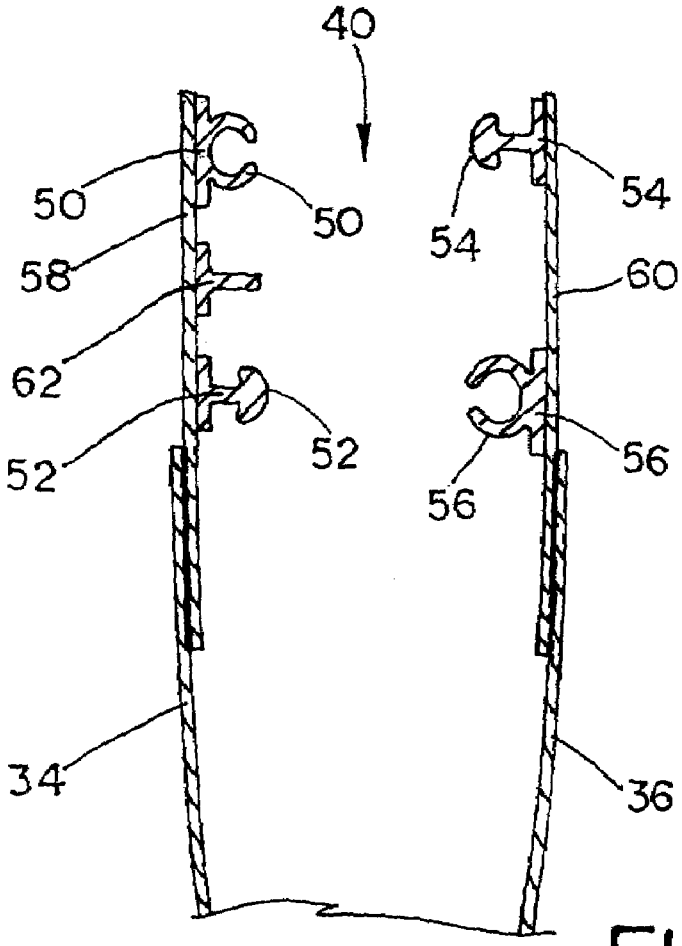
FIG. 2 is an enlarged partial cross-sectional view along line 2-2 of FIG. 1 of an embodiment of an elongate seal assembly profile in a de-occluded position with portions behind the plane of the cross-section omitted for clarity.
Figure 3A:
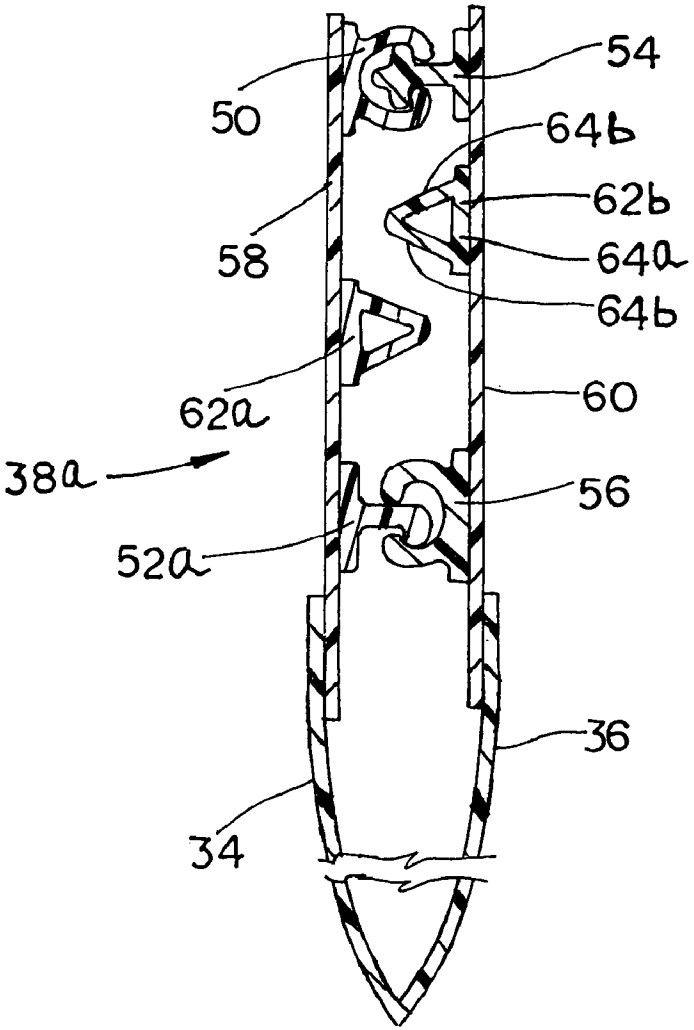
FIG. 3A is a view similar to FIG. 3 of a seal assembly profile according to another embodiment of the invention.
Figure 3:
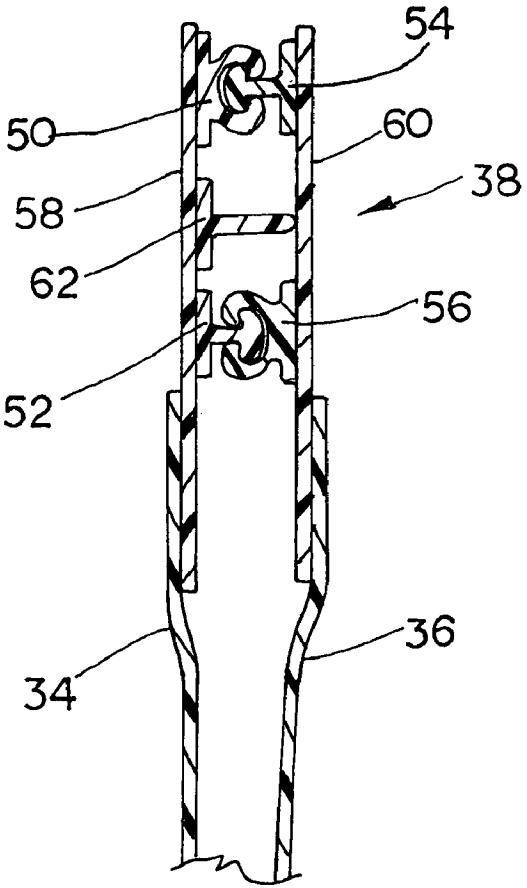
FIG. 3 is view similar to FIG. 2 of the seal assembly profile in an occluded position along line 3-3.

As shown in FIGS. 2 and 3, the sealing elements 46 of the seal assembly 38 include a first closure element 50 and a second closure element 52 on a first backing member 58 and a third closure element 54 and a fourth closure element 56 on an opposing second backing member 60, which is often referred to as a double zipper. In one embodiment, the backing members 58, 60 are connected to top edges of the sidewalls 34, 36, respectively and in another embodiment, the backing members 58, 60 are simply extensions or part of the sidewalls 34, 36. An elongate ridge or rib 62 extends substantially the length of the seal assembly 38 on the first sidewall 34 and is spaced between the first and second closure elements 50, 52. When the seal assembly 38 is in an occluded or sealed configuration (shown in FIG. 3) the opposing closure elements 50, 54 (i.e., upper closure elements) and the opposing closure elements 52, 56 (i.e., lower closure elements) interlock, and the rib 62 extends substantially between the first backing member 58 and the second backing member 60.

In one embodiment, the first and fourth closure elements 50, 56 have female C-shaped interlocking profiles, and the second and third closure elements 52, 54 have male double hook arrow interlocking profiles. However, the specific shape and configuration of the individual closure elements 50-56 and the rib 62 can be altered without departing from the spirit of the invention. In another embodiment, for example, the profile of the seal assembly 38 may include additional closure elements in order to create a more secure and leak resistant seal and/or may contain both female elements on one sidewall and corresponding male elements on the opposing sidewall.

In FIG. 3A, another embodiment of a seal assembly 38*a* according to the present invention, in which similar structures are designated with similar reference numbers, includes an elongate hollow rib profile 62*a* disposed an interior surface of the backing member 58 and an elongate hoilow rib profile 62*b* disposed on an interior surface of the backing member 60. The seal assembly 38*a* also includes a second closure element 52*a*, which has an asymmetric profile that includes a single hook disposed at a distal end of a shaft, in addition to the C-shaped interlocking profiles of the first and fourth closure elements 50, 56, and the double hook arrow interlocking profile of the third profile 54, in a similar configuration to the closure elements shown in the seal assembly disclosed in commonly owned U.S. patent application Ser. No. 10/875, 391, filed Jun. 24, 2004 by James Pawloski and incorporated herein by reference in the entirety. In one embodiment, the hook of the closure element 52*a* is turned toward an interior, or product side of the seal assembly 38*a*, and in another embodiment, the hook is turned toward an exterior, or user side of the seal assembly. The hollow rib profile 62*a* is a non-interlocking rib or ridge, which does not interlock with, for example, the opposite elongate hollow rib profile 62*b* or a complementary interlocking member. The hollow rib profile 62*a* is disposed between the closure element 50 and the closure element 52*a;* and the hollow rib profile 62*b* is disposed between the closure element 54 and the closure element 56 offset from the hollow rib profile 62*a*. When the seal assembly 38*a* is fully occluded, such as shown in FIG. 3, the distal end of the hollow rib profile 62*a* extends laterally beyond the distal end of the hollow rib profile 62*b*. Each of the hollow rib profiles 62*a*. 62*b* has a generally triangular hollow profile including a base member 64*a* laminated to the respective backing member 58 or 60 and two arm members 64*b* that extend from the base member and merge together. The hollow triangular rib profiles 62*a*, 62*b* may be formed by extruding a U-shaped profile onto the backing respective members. 58. 60 in such a manner that urges the distal ends of the U-shaped profile to merge together and bond while still molten. The hollow rib profiles 62*a*, 62*b* in other embodiments may have different shapes, such as round, oval, square, or a non-geometric shape; and1 in yet other embodiments, the hollow rib profiles 62*a*, 62*b* may be in opposing relation rather than being offset. The seal assembly may be formed of thermoplastic, such as low density polyethylene (LDPE), high density polyethylene (HDPE), linear low density polyethylene (LLDPE), and combinations thereof. In one embodiment, for example, the backing members 58, 60 are formed of a mixture of HDPE, LDPE, and LLDPE to be more rigid, and the closure elements 50-56, 52*a* and ribs 62, 62*a*, 62*b* are formed of LDPE to be suppler. The seal assembly 38*a* may be disposed on a bag, such as by laminating the backing members 58, 60 to sidewalls 34, 36, respectively, of the bag 32.

In one embodiment, the rib 62 (or 62*a* and 62*b*) has a portion that does not exert as much, or any, opening force against a separating member of the slider than other portions of the rib, as discussed in detail below. As shown in FIG. 1, the rib 62, 62*a* has a section 64 extending a length from the closed end 44, where the rib is deformed, such as by having a shorter profile, i.e., the rib does not extend as far from the backing member 58, as the rib does along other portions along the length of the seal assembly. The shortened section 64 allows the seal assembly 38 to conform to the slider 48 and to reduce the opening force of the slider when it is positioned at the closed end. The shorter profile of the section 64 may be formed as a cut away end portion of the rib 62, 62*a*, a bent over end portion of the rib, or a crushed down portion of the rib. In another embodiment, the section 64 may be formed by slitting the protruding member or members of the rib 62 or 62*a* so that rib is less rigid or forming the rib of material that is less resilient than other portions thereof.

One embodiment of a slider 70, which is illustrated in FIGS. 4-10B, includes first and second opposing faces 72, 74 extending from a top wall 76 defining a channel 78 therebetween in which a double zipper, such as the seal assembly 38, can be operatively accepted. The slider 70 has a closing end 82 opposite an opening end 84. First closing members, such as forward closure bars 86, extend into the channel 78 from the opposing faces 72, 74 of the slider 70 toward a center axis thereof at or near the closing end 82. The forward closure bars 86 define a gap therebetween for operatively accepting the seal assembly 38, and in one embodiment are adapted to engage and/or occlude the upper closure elements 50, 54 and the lower closure elements 52, 56. A central protrusion, such as a separator finger 92, extends from the top wall 76 into the channel 78 spaced between the first and second opposing faces 72, 74 and is disposed adjacent to the opening end 84. The separator finger 92 includes a wedged nose portion 94 near the opening end 84 to gently separate the upper closure elements 50, 54 and a tapered tail portion 96 extending toward the closing end 82. The wedged nose portion 94 of the separator finger 92 also presses outwardly against the rib 62 to de-occlude the double zipper. In one embodiment, a distal end of the separator finger 92 is disposed between the rib 62 and the lower closure members 52, 56 such that the separator finger does not extend between the lower closure members. Second closing members, such as lower closure bars 100, are located behind the wedged nose portion 94 of the separator finger 92 near the opening end 84 of the slider 70. The lower closure bars 100 define a gap therebetween for operatively accepting the seal assembly 38 and are adapted to engage and occlude only the lower closure members 52, 56. A hanger member 102 extends from the top wall 76 along a longitudinal centerline thereof that carries a retaining member, such as a retention plate 104. The retention plate is disposed in the channel 78 between the first and second opposing faces 72, 74 and spaced from and generally parallel to the top wall 76. In one embodiment, the retention plate 104 is disposed between the upper closure members 50, 54 and the rib 62 and engages an underside (i.e., a side facing the rib 62) of the upper closure members to slidingly retain the slider 70 thereon. In another embodiment (shown in dashed lines in FIG. 8), the retention plate 104 is disposed between the rib 62 and the lower closure members 52, 56 and engages an underside of the rib to slidingly retain the slider 70 thereon. Pressing members, such as a plurality of protrusions 106, extend into the channel 78 from the first and second opposing faces 72, 74 and press the backing members 58, 60 toward and/or against the retention plate 104 to help maintain the slider 70 operationally engaged on the seal assembly 38. In one embodiment, the retention plate 104 and the protrusions 106 also help maintain the rib 62 in a substantially rigid and perpendicular position relative to the backing member 58 to increase the opening force of the separator finger 92 against the rib.

In one embodiment, the retention plate 104 includes a first rectangular plate 108 and a second rectangular plate 110 joined by the hanger member 102. In addition, an opposing pair of the protrusions 106 is laterally disposed adjacent to a closing end side of each respective first and second rectangular plate 108, 110. The top wall 76 of the slider 70 includes first and second windows 112 and 114, which are aligned over and substantially coextensive with the lower closure bars 100, respectively, and third and fourth windows 116 and 118, which are aligned over and substantially coextensive with the first and second retention plates 108, 110, respectively.

In another embodiment (not shown), the slider may be operatively retained on the seal assembly 38 with other slidable retention mechanisms. For example, the seal assembly 38 may include a rail disposed on an exterior side of one or both of the backing members and the slider 70 may have an in-turned flange that slideably engages under the rail. Such a retention mechanism may be in addition to or alternative to the retention plate 104.

Figure 10B:
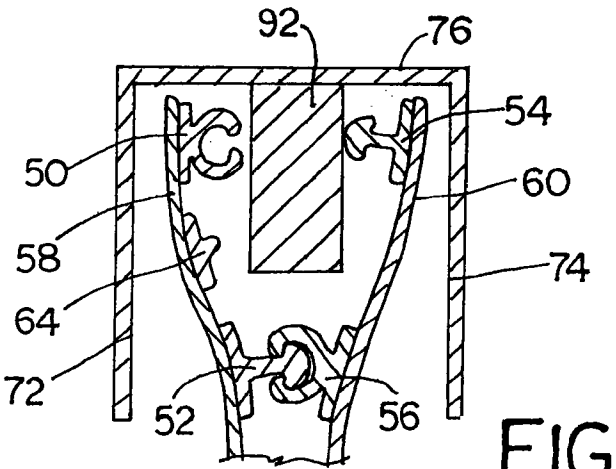
FIG. 10B is another view similar to FIG. 8 taken along line 10-10 in FIG. 4 with the slider at a closed end of the seal assembly.
Figure 10A:
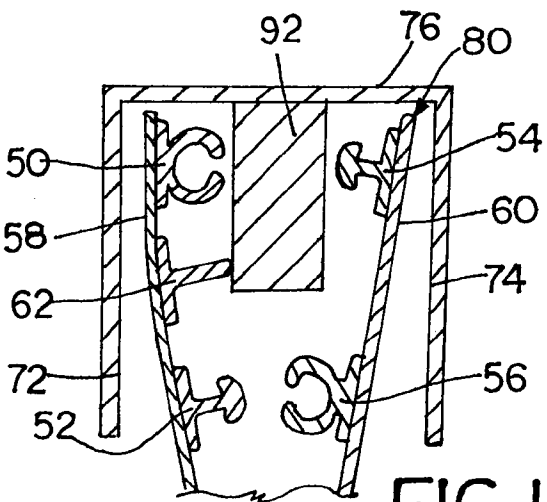
FIG. 10A is a view similar to FIG. 8 taken along line 10-10 in FIG. 4 with the slider along a medial portion of the seal assembly.

Referring to FIGS. 7-10B, when the slider 70 operatively moves, such as by being slid by a user, along the seal assembly 38 in an occluding direction, i.e., away from the closing end 82, the forward closure bars 86 occlude both the upper closure members 50, 54 and the lower closure members 52, 56, and the lower closure bars 100 occlude only the lower closure members. As shown in FIG. 10B, the rib 62 has a section 64 near the closed end 44 of the seal assembly 38 that does not press against the separator finger 92 with as much (or any) force as the rib does along the remaining length of the seal assembly so that the separator finger 92 does not force apart the lower interlocking profiles 90 adjacent to the closed end. The section 64 may is formed with a rib 62 having a shorter profile, such as by simply being cut shorter or by being deformed to not extend as far from the backing member 58. In another embodiment (not shown), the section 64 may be formed with a slit or reduced section to allow the rib 62 or 62*a* to bend with less force. The section 64 preferably extends at least to a distance from the closed end 44 as far as a distance between the nose portion 94 and the lower closure bars 100. The lower closure bars 100 are able to occlude the portions of the lower closure members 52, 56 that are co-extensive with the section 64 because the reduced rib 62 provides less opening force to urge the lower closure members apart than at the remaining portions of the seal assembly 38. As a result, the lower closure members 52, 56 are occluded along the entire length of the seal assembly 38 underneath (i.e., on an interior side of the bag) of the separator finger 92 by the lower closure bars 100, even at the closed end of the seal assembly 38, when the slider 70 is positioned against the closed end 44. When the slider 70 operatively moves in a de-occluding direction, i.e., away from the opening end 84, the separator finger 92 de-occludes the upper closure members 50, 54 by extending therebetween and forces apart the lower closure members 52, 56 by pressing outwardly against the rib 62, as seen in FIG. 10A. The retention plate 104 and the protrusions 106 help prevent the slider 92 from disengaging from the seal assembly 38 and also support the rib 62, thereby increasing the opening force created by the separator finger 92 against the rib.

The slider 70 is readily adapted to occlude and de-occlude the seal assembly 38*a* in a similar manner as the seal assembly 38 with the separator finger pressing outwardly in opposite directions against both the hollow rib profile 62*a* and the hollow rib profile 62*b* the retention. One or both of the hollow rib profiles 62*a*, 62*b* may have less pressing force, such as by being deformed, along the section 64. The retention plate 104 may engage a product side of one or both of the upper closure elements 50, 54, and/or either or both of the hollow rib profiles 62*a*, 62*b*.

Figure 4:
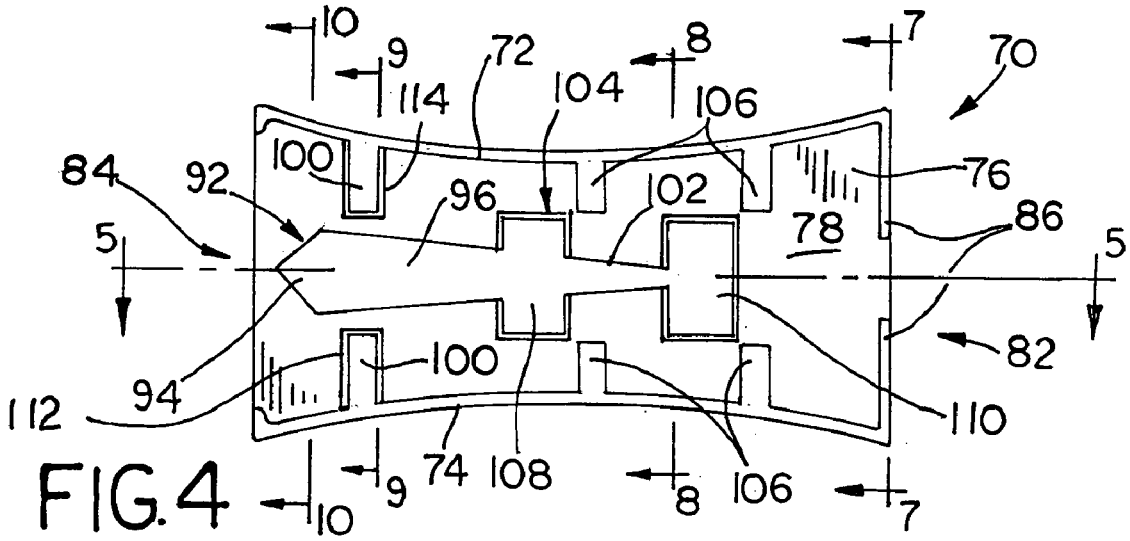
FIG. 4 is a bottom view of one embodiment of a slider according to the present invention.
Figure 5:
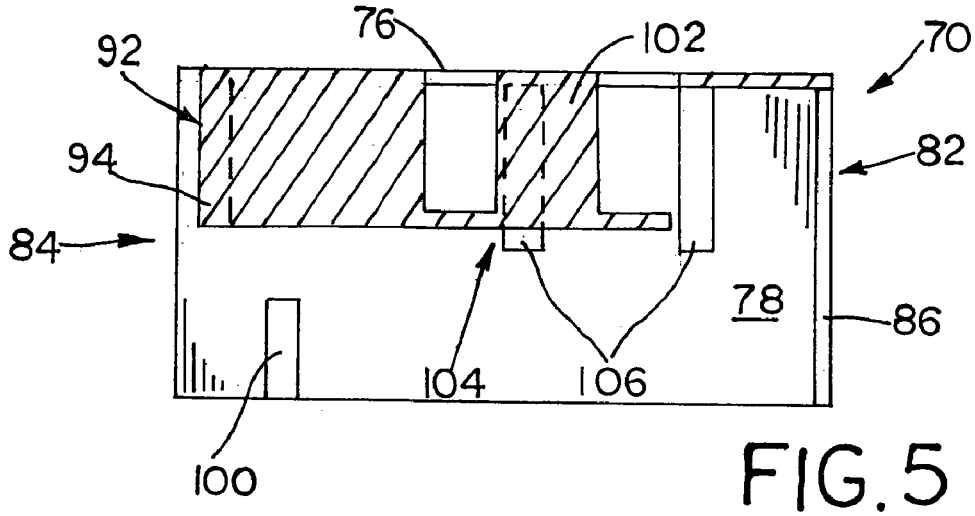
FIG. 5 is a cross sectional view along line 5-5 of the slider illustrated in FIG. 4.
Figure 6:
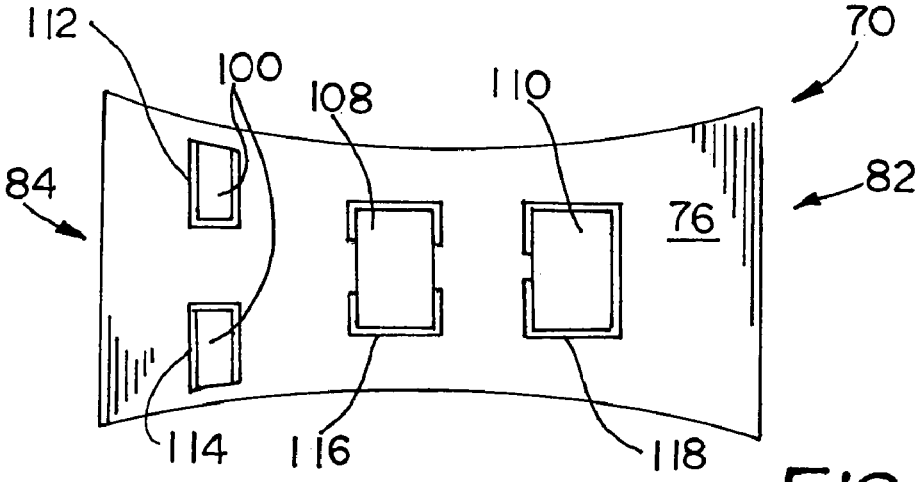
FIG. 6 is a top view of the slider in FIG. 4.
Figure 9:
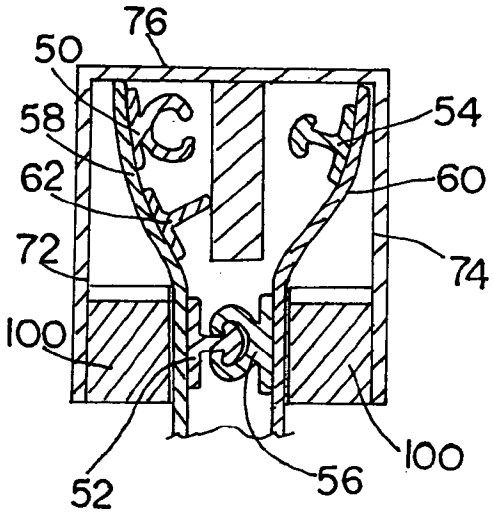
FIG. 9 is a view similar to FIG. 8 taken along line 9-9 in FIG. 4.
Figure 8:
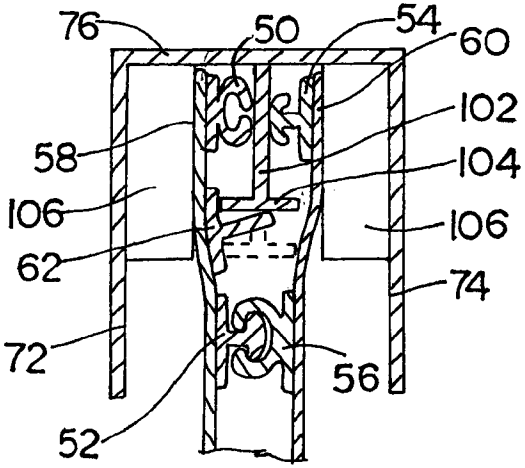
FIG. 8 is a view similar to FIG. 7 taken along line 8-8 in FIG. 4.
Figure 7:
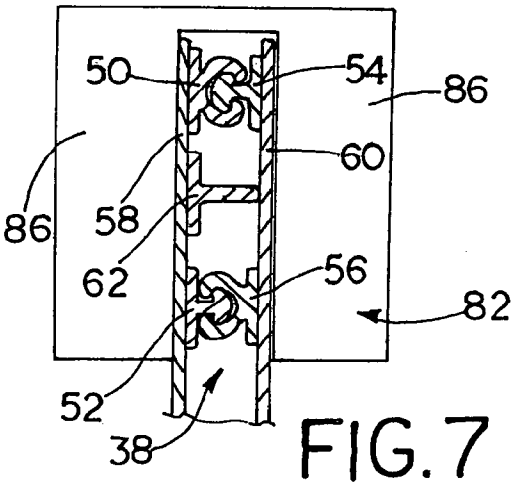
FIG. 7 is an enlarged partial cross-sectional view taken along line 7-7 in FIG. 4 showing a closing end of the slider when operatively engaged on the seal assembly of FIGS. 2 and 3 with portions behind the plane of the cross-section omitted for clarity.
Figure 11:
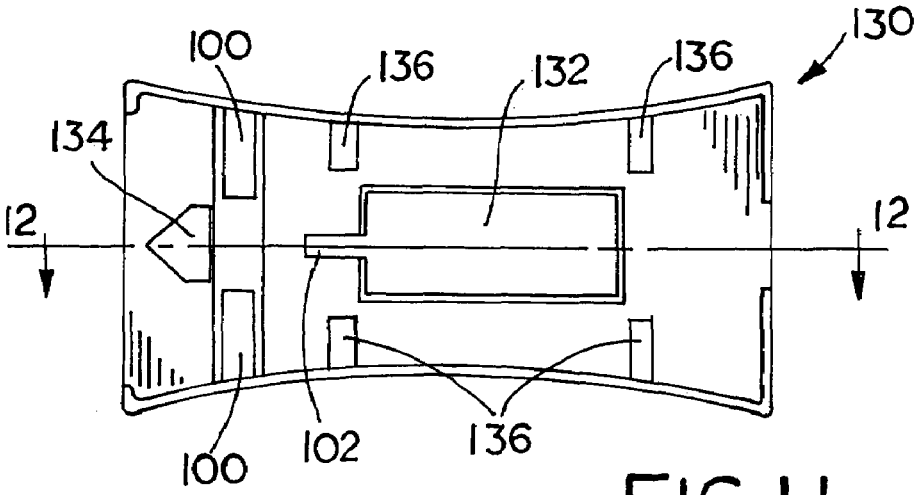
FIG. 11 is a bottom view of a slider according to another embodiment of the invention.
Figure 12:
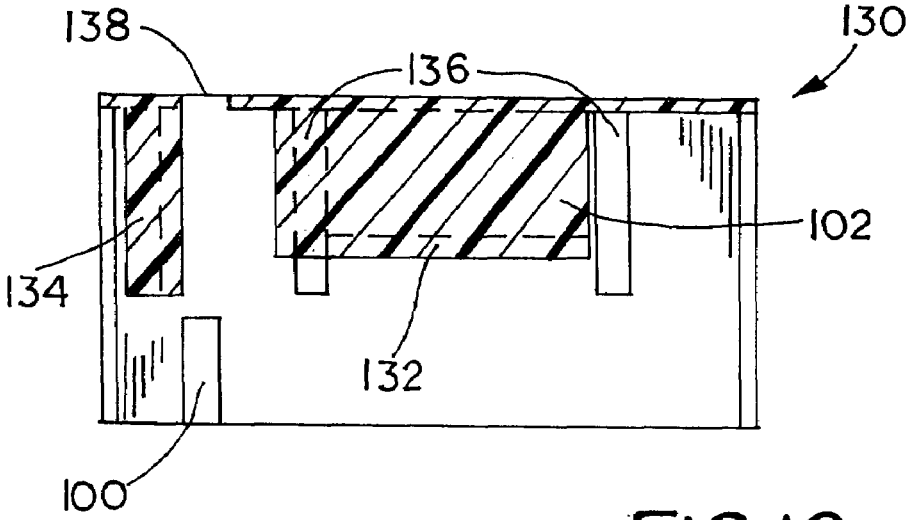
FIG. 12 is a cross-sectional view taken along line 12-12 of the embodiment shown in FIG. 11.
Figure 13:
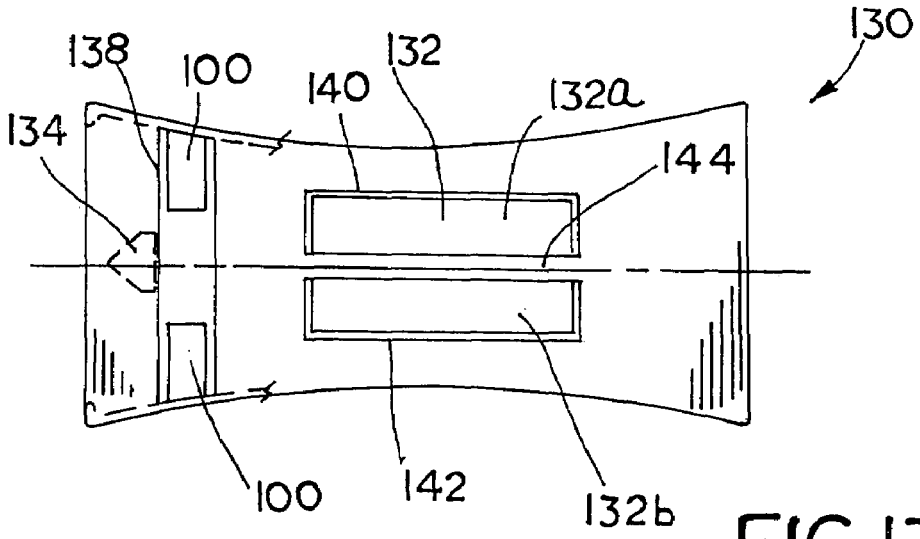
FIG. 13 is a top view of the embodiment shown in FIG. 11.

In FIGS. 11-13, another embodiment shown of a slider 130 according to the present invention is substantially the same as the slider 70 shown in FIGS. 4-6, except that the retaining member is a single rectangular plate 132, and the separator finger 134 is a triangular wedge-shaped projection extending from the top wall 76 that does not have a tapered tail portion. The separator finger 134 is spaced longitudinally from the rectangular plate 132. Two pairs of pressing members, such as, pressing bars 136, are disposed longitudinally forward and rearward of the rectangular plate 132. A first window 138 through the top wall 76 extends substantially the width of the top wall and is aligned over the lower closure bars 100. Second and third windows 140 and 142 are aligned over the rectangular plate 132. The second and third windows 140, 142 are substantially coextensive with first and second opposite longitudinal sides 132*a*, 132*b* of the rectangular plate 132 and are spaced from each other along the longitudinal centerline of the top wall 76. The hanger member 102 depends into the channel from a portion 144 of the top wall 76 disposed between the second and third windows 140, 142.

Figure 14:
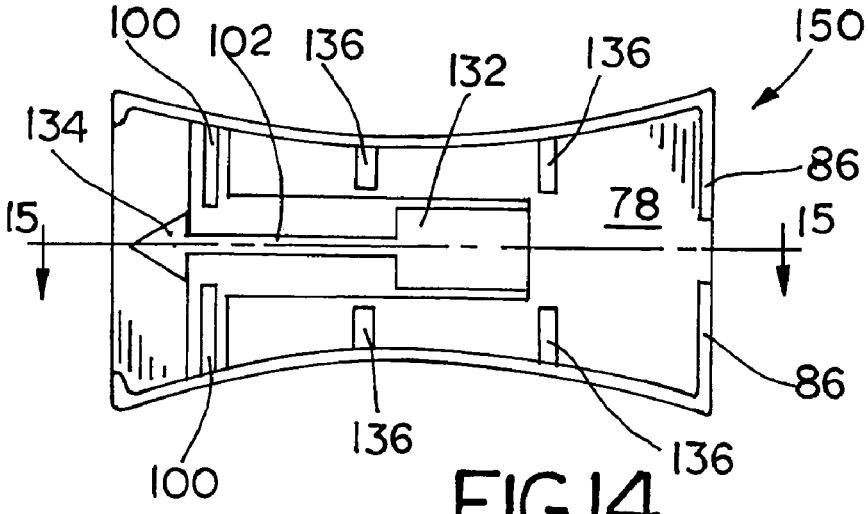
FIG. 14 is a bottom view of a slider according to yet another embodiment of the invention.
Figure 15:
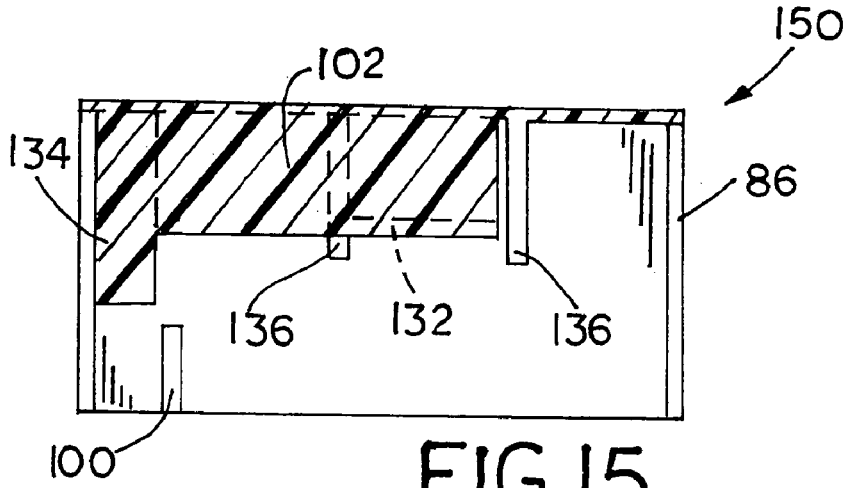
FIG. 15 is a cross-sectional view taken along line 15-15 of the embodiment shown in FIG. 14.
Figure 16:
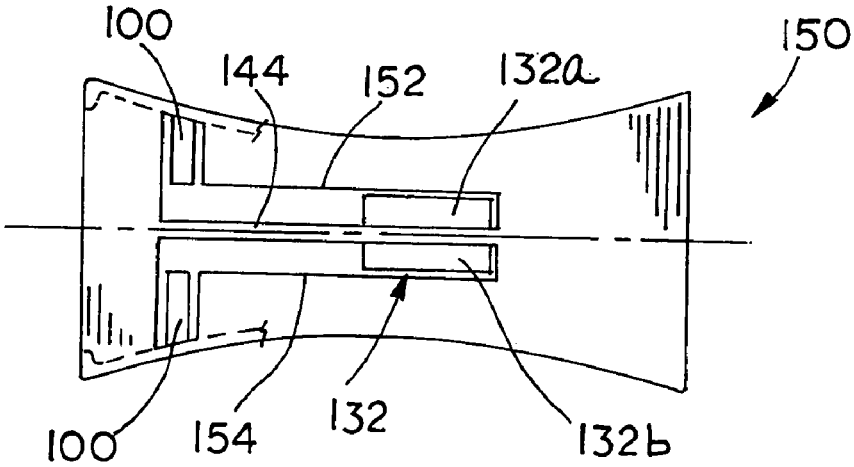
FIG. 16 is a top view of the embodiment shown in FIG. 14.

Yet another embodiment of a slider 150 according to the present invention, illustrated in FIGS. 14-16, is substantially similar to the slider 130 shown in FIGS. 11-13, except that the longitudinal hanger member 102 extends from the separator finger 134 through the rectangular plate 132. A first L-shaped window 152 through one lateral side of the top wall 76 of the slider 150 is aligned over one of the lower closure bars 100 and one side 132*a* of the rectangular plate 132; and a second L-shaped window 154 through the other lateral side of the top wall is aligned over the other lower closure bar 100 and the other side 132*b* of the retention plate. The first and second L-shaped windows 152, 154 are spaced from each other along a medial portion 144 of the longitudinal centerline of the top wall 76.

Each of the sliders illustrated and described herein may be operatively engaged with a double zipper, such as the seal assembly 38 and/or the seal assembly 38*a*. Furthermore, it is contemplated that parts and features of any one of the specific embodiments can be interchanged with parts and features of any of the other embodiments without departing from the spirit of the invention.

INDUSTRIAL APPLICABILITY

The closure assemblies described herein provide a beneficial way of sealing and resealing openings of almost any kind, such as by occluding and de-occluding a pouch or a thermoplastic bag for storing products therein. The double zipper profile may provide a multiple barrier seal when the opposing interlocking profiles are occluded. The slider may completely seal and unseal the double zipper profile without having any leaks when the slider is at the closed end of the double zipper or any holes through the bag walls or backing members to provide a docking area for the slider.

Numerous modifications to the present disclosure will be apparent to those skilled in the art in view of the foregoing description. Accordingly, this description is to be construed as illustrative only and is presented for the purpose of enabling those skilled in the art to make and use the closure assembly of the disclosure and to teach the best mode of carrying out same. The exclusive right of all variations within the scope of the impending claims is reserved.

We claim:

1. A resealable closure assembly, comprising:

a first backing member including a first plurality of mating elements extending along the first backing member;

a second backing member opposing the first backing member including a second plurality of mating elements extending along the second backing member, wherein the first plurality of mating elements resealably interlockingly mates with the second plurality of mating elements;

a non-interlocking rib extending along the first backing member and disposed between two adjacent mating elements of the first plurality of mating elements; and a slider adapted to mate and unmate the first and second plurality of mating elements, wherein the slider includes a separator finger that unmates a first pair of opposing mating elements of the first and second plurality of mating elements by pressing outwardly against the rib, and wherein the first pair of opposing mating elements is disposed beyond a distal end of the separator finger.

2. The resealable closure assembly of claim 1, wherein the first pair of opposing mating elements extends completely between opposite ends of an opening defined between the first backing member and the second backing member.

3. The resealable closure assembly of claim 1, wherein the first pair of opposing mating elements comprises an asymmetrical hook profile adapted to interlock with an opposing interlocking profile.

4. The resealable closure assembly of claim 1, wherein the separator finger is disposed proximate to an opening end of the slider, and wherein the slider includes a first closing member positioned proximate to a closing end of the slider opposite the opening end and a second closing member disposed between the first closing member and the separator finger, and wherein the second closing member is adapted to mate the first pair of opposing mating elements.

5. A resealable closure assembly, comprising:

a first backing member including a first plurality of mating elements extending along the first backing member;

a second backing member opposing the first backing member including a second plurality of mating elements extending along the second backing member, wherein the first plurality of mating elements resealably interlockingly mates with the second plurality of mating elements;

a rib extending along the first backing member and disposed between two adjacent mating elements of the first plurality of mating elements; and a slider adapted to mate and unmate the first and second plurality of mating elements, wherein the slider includes a separator finger that unmates a first pair of opposing mating elements of the first and second plurality of mating elements by pressing outwardly against the rib, wherein the first pair of opposing mating elements is disposed beyond a distal end of the separator finger, and wherein a first portion of the rib near one end of the closure assembly is adapted to provide less opening force against the separator finger than at other portions along the closure assembly.

6. The resealable closure assembly of claim 5, wherein the rib has a shorter profile at the first portion than at the other portions.

7. A resealable closure assembly, comprising;

a first backing member including a first plurality of mating elements extending along the first backing member;

a second backing member opposing the first backing member including a second plurality of mating elements extending along the second backing member, wherein the first plurality of mating elements resealably interlockingly mates with the second plurality of mating elements;

a rib extending along the first backing member and disposed between two adjacent mating elements of the first plurality of mating elements; and a slider adapted to mate and unmate the first and second plurality of mating elements, wherein the slider includes a separator finger that unmates a first pair of opposing mating elements of the first and second plurality of mating elements by pressing outwardly against the rib, and wherein the first pair of opposing mating elements is disposed beyond a distal end of the separator finger, wherein the slider includes a retaining member disposed between the first backing member and the second backing member and between at least one of the plurality of mating elements and the rib, and wherein the siider includes protrusions for pressing the first and second backing members toward the retention member.

8. The resealable closure assembly of claim 7, wherein the rib comprises an elongate hollow triangular profile.

9. A reclosable closure assembly, comprising:

a first closure element disposed along a first backing member and a second closure element disposed along the first backing member and spaced from the first closure element;

a third closure element disposed along a second backing member opposite the first backing member and a fourth closure element disposed along the second backing member and spaced from the third closure element;

an elongate non-interlocking ridge extending along the first backing member and disposed between the first and second closure elements; and a slider adapted to occlude and de-occlude the first and second closure elements with the third and fourth closure elements, respectively, wherein the slider includes a central protrusion that extends between the first and third closure elements and de-occludes the second and fourth closure elements by pressing outwardly against the elongate ridge, wherein the central protrusion does not extend between the second and fourth closure elements.

10. The reclosable closure assembly of claim 9, wherein the elongate ridge is deformed to provide less pressing resistance against the central protrusion for a distance extending from an end of the reclosable closure assembly.

11. The reclosable closure assembly of claim 9, wherein the first and fourth closure elements are female interlocking profiles and the second and third closure elements are corresponding male interlocking profiles, and wherein the second closure element comprises an asymmetrical hook profile.

12. The reclosable closure assembly of claim 9, wherein the slider occludes the second and fourth closure elements along substantially an entire length of an opening defined between the first backing member and the second backing member.

13. The reclosable closure assembly of claim 9 further comprising a second elongate ridge extending along the second sidewall and disposed between the third and fourth closure elements, wherein the central protrusion presses outwardly against the second elongate ridge.

14. A reclosable closure assembly, comprising:

a first closure element disposed along a first backing member and a second closure element disposed alone the first backing member and spaced from the first closure element;

a third closure element disposed alone a second backing member opposite the first backing member and a fourth closure element disposed along the second backing member and spaced from the third closure element;

an elongate ridge extending along the first backing member and disposed between the first and second closure elements; and a slider adapted to occlude and de-occlude the first and second closure elements with the third and fourth closure elements, respectively, wherein the slider includes a central protrusion that extends between the first and third closure elements and de-occludes the second and fourth closure elements by pressing outwardly against the elongate non-interlocking ridge, wherein the central protrusion does not extend between the second and fourth closure elements, and wherein the slider includes first closure bars proximate to a closing end opposite an opening end, wherein the central protrusion is proximate to the opening end, wherein the slider further includes second closure bars disposed between the first closure bars and the central protrusion and spaced from an upper wall of the slider, wherein the first closure bars engage the first and third closure elements and the second and fourth closure elements, respectively, and wherein the second closure bars engage only the second and fourth closure elements.

15. The reclosable closure assembly of claim 14, wherein the slider includes a retention plate disposed between the first backing member and the second backing member, and wherein the retention plate extends toward at least one of the first and second backing members between the first and second closure elements or the third and fourth closure elements, respectively.

16. The reclosabie closure assembly of claim 15, wherein the retention plate is spaced from the central protrusion and maintains the elongate ridge in a substantially perpendicular position relative to the first sidewall.

17. A reclosable closure assembly, comprising:

a first closure element disposed along a first backing member and a second closure element disposed along the first backing member and spaced from the first closure element;

a third closure element disposed along a second backing member opposite the first backing member and a fourth closure element disposed along the second backing member and spaced from the third closure element;

a first elongate ridge extending alone the first backing member and disposed between the first and second closure elements; and a slider adapted to occlude and de-occlude the first and second closure elements with the third and fourth closure elements, respectively, wherein the slider includes a central protrusion tat extends between the first and third closure elements and de-occludes the second and fourth closure elements by pressing outwardly against the elongate ridge, wherein the central protrusion does not extend between the second and fourth closure elements; and a second elongate ridge extending alone the second backing member and disposed between the third and fourth closure elements, wherein the central protrusion presses outwardly against the second elongate ridge, wherein the first elongate ridge comprises a hollow triangular profile, and wherein the first elongate ridge is offset from the second elongate ridge.

* * * * *

UNITED STATES PATENT AND TRADEMARK OFFICE

CERTIFICATE OF CORRECTION

PATENT NO. : 7,574,781 B2
APPLICATION NO. : 11/453610
DATED : August 18, 2009
INVENTOR(S) : Bryan L. Ackerman, Leland J. Smith and James C. Pawloski It is certified that error appears in the above-identified patent and that said Letters Patent is hereby corrected as shown below:

Column 8, Line 27: replace "unmates a first" with --unmates the first--

Column 9, Line 29: replace "siider" with --slider--

Column 10, Line 66: replace "tat" with --that--

Column 11, Line 5: replace "alone" with --along--

Signed and Sealed this

Sixth Day of October, 2009

David J. Kappos

David J. Kappos
*Director of the United States Patent and Trademark Office*